United States Patent [19]

Hiraoka et al.

[11] Patent Number: 4,603,673

[45] Date of Patent: Aug. 5, 1986

[54] BREATHER DEVICE IN INTERNAL COMBUSTION ENGINE

[75] Inventors: Shin Hiraoka; Koji Asanomi; Ryoji Abe, all of Hiroshima, Japan

[73] Assignee: Mazda Motor Corporation, Hiroshima, Japan

[21] Appl. No.: 706,643

[22] Filed: Feb. 28, 1985

[30] Foreign Application Priority Data

Mar. 3, 1984 [JP] Japan ..... 59-41663
Mar. 3, 1984 [JP] Japan ..... 59-41664

[51] Int. Cl.[4] ..... F02B 25/06
[52] U.S. Cl. ..... 123/573; 123/572
[58] Field of Search ..... 123/572, 573, 574, 41.86

[56] References Cited

U.S. PATENT DOCUMENTS

| | | | |
|---|---|---|---|
| 2,493,617 | 1/1950 | Chubbuck | 123/573 |
| 2,796,853 | 6/1957 | Van Ranst . | |
| 2,797,674 | 7/1957 | Dolza | 123/572 |
| 3,730,160 | 5/1973 | Hughes . | |
| 3,946,710 | 3/1976 | Albano et al. . | |
| 3,949,719 | 4/1976 | Bellanca et al. . | |
| 4,156,406 | 5/1979 | Brandau et al. . | |
| 4,528,969 | 7/1985 | Senga | 123/573 |

FOREIGN PATENT DOCUMENTS 5941664 10/1977 Japan .

*Primary Examiner*—Ronald H. Lazarus
*Attorney, Agent, or Firm*—Burns, Doane, Swecker & Mathis

[57] ABSTRACT

A crankcase ventilating system for a V-type, OHC internal combustion engine comprising a substantially hollow engine body structure having a pair of upwardly diverging cylinder banks and an oil pan secured to the body structure from below to define a crankcase, and also having a pressure buffer chamber, defined between the cylinder banks, at least one engine cylinder, defined in each of the cylinder banks, and a cam chamber defined therein at top of each of the cylinder banks, and an intake system for the introduction of a controlled combustible air-fuel mixture into the engine cylinders. The system comprises first separate oil return passages each defined in the body structure and communicating between the respective engine cylinder and the buffer chamber, and a connecting passage communicating between the buffer chamber and the crankcase. The connecting passage comprises a blow-by gas passage portion, having one end in communication with the crankcase and the other end projecting a distance into and in communication with the buffer chamber, and a second oil return passage portion having one end in communication with the crankcase and the other end opening at the bottom of and in communication with the buffer chamber.

16 Claims, 5 Drawing Figures

BREATHER DEVICE IN INTERNAL COMBUSTION ENGINE

CROSS-REFERENCE TO RELATED APPLICATION

U.S. patent application Ser. No. 584,892 now U.S. Pat. No. 4,541,399 filed Feb. 29, 1984 by T. Tanaka et al. and assigned to the same assignee of the instant application.

BACKGROUND OF THE INVENTION

The present invention generally relates to a crankcase ventilating system for an internal combustion engine and, more particularly, to a breather device in the internal combustion engine for lessening the change in pressure within the crankcase.

The present invention is particularly applicable to a V-type, OHC automobile engine, i.e., an automobile engine of a type employing an overhead camshaft (OHC) system and having engine cylinders in two banks arranged in a V-shaped configuration.

Of the numerous problems tackled by automobile technicians and specialists, there is a problem associated with blow-by gases leaking from the combustion chamber into the crankcase through between the piston rings and the cylinder wall. One solution to this problem includes the recirculation of the blow-by gases from the crankcase into the intake manifold together with air, ventilated from the crankcase, so that they re-enter the engine cylinders for the re-combustion therein. On the other hand, it is well known that the pressure within the crankcase is susceptible to change under the influence of the pumping action of the reciprocating pistons, or the changes in amount of the blow-by gases leaking into the crankcase or for some other reasons, and therefore, where the crankcase is communicated direct with the intake manifold, the blow-by gases are apt to be introduced under varying pressure into the engine cylinder with the consequence of both the reduced engine operating performance and the increased oil consumption.

In view of the foregoing, the currently employed solution to the problem of the blow-by gases is generally accompanied by the employment of a breather chamber (pressure buffer chamber) in the fluid circuit between the crankcase and the intake manifold for lessening the change in pressure within the crankcase.

For example, the Japanese Patent Publication No. 52-39983, published Oct. 8, 1977, discloses the use of the breather chamber defined in the crankcase of the V-type internal combustion engine at each outer side of the respective banks of engine cylinders. The breather chambers disclosed therein are constituted by cavities formed during the casting of the engine cylinder block structure and subsequently closed by respective lids. It has, however, been found that, since the breather chambers are defined at the outer sides of the respective cylinder banks, the walls defining the breather chambers tend to protrude outwards increasing the size of the engine as a whole particularly where the respective volumes of the breather chambers are increased for increasing not only the capability of lessening the change in pressure within the crankcase brought about by the blow-by gases but also the capability of separating oil from the oil-laden medium coming from the crankcase. The increased size of the engine ofren imposes a limitation on the set-up and installation of some operatively associated instruments and pipings around the engine within a limited surrounding space.

SUMMARY OF THE INVENTION

The present invention has been developed with a view to substantially eliminating the above discussed disadvantages and inconveniences inherent in the prior art crankcase ventilating system for the V-type, OHC internal combustion engine and has for its essential object to provide an improved crankcase ventilating system for a V-type, OHC internal combustion engine wherein a dead space present between the cylinder banks is effectively utilized to define the breather chamber with no need to increase the apparent size of the engine for the purpose of increasing both the capability of lessening the change in crankcase pressure and the oil separating capability.

Another object of the present invention is to provide an improved crankcase ventilating system of the type referred to above, wherein separate passages are employed for the circulation of the blow-by gases from the crankcase to the intake manifold and for the return of the separated oil back into the crankcase, respectively, to avoid the possibility of the separated oil being remixed with the blow-by gases being circulated to the intake manifold.

A further object of the present invention is to provide an improved crankcase ventilating system of the type referred to above, wherein a wall member used to define the breather chamber concurrently acts as a reinforcement for imparting a rigidity to each of the cylinder banks so that the vibration induced by the engine during the operation of the latter can advantageously be suppressed.

In order to accomplish these objects of the present invention, there is provided, in accordance with the present invention, a crankcase ventilating system for a V-type, OHC internal combustion engine comprising a substantially hollow engine body structure having a pair of upwardly diverging cylinder banks and a generally rectangular, downwardly facing opening, said engine body structure also having a pressure buffer chamber defined between the cylinder banks, said engine body structure further having at least one engine cylinder, defined in each of the cylinder banks, and a cam chamber defined therein at top of each of the cylinder banks at a location opposite to the downwardly facing opening, and an intake system for the introduction of a controlled combustible air-fuel mixture into the engine cylinders, said intake system including an air intake passage having a throttle valve disposed therein for regulating the flow of the air therethrough. An oil pan is secured to the engine body structure over the downwardly facing opening to define a crankcase. The system also comprises first separate oil return passages each defined in the engine body structure and communicating between the respective engine cylinder and the buffer chamber, and a connecting passage means communicating between the buffer chamber and the crankcase. The connecting passage means comprises a blow-by gas passage, having one end in communication with the crankcase and the other end projecting a distance into and in communication with the buffer chamber, and a second oil return passage having one end in communication with the crankcase and the other end opening at the bottom of and in communication with the buffer chamber, said other end of the gas passage being located at a level above the bottom of the buffer chamber.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE EMBODIMENT

Figure 1:
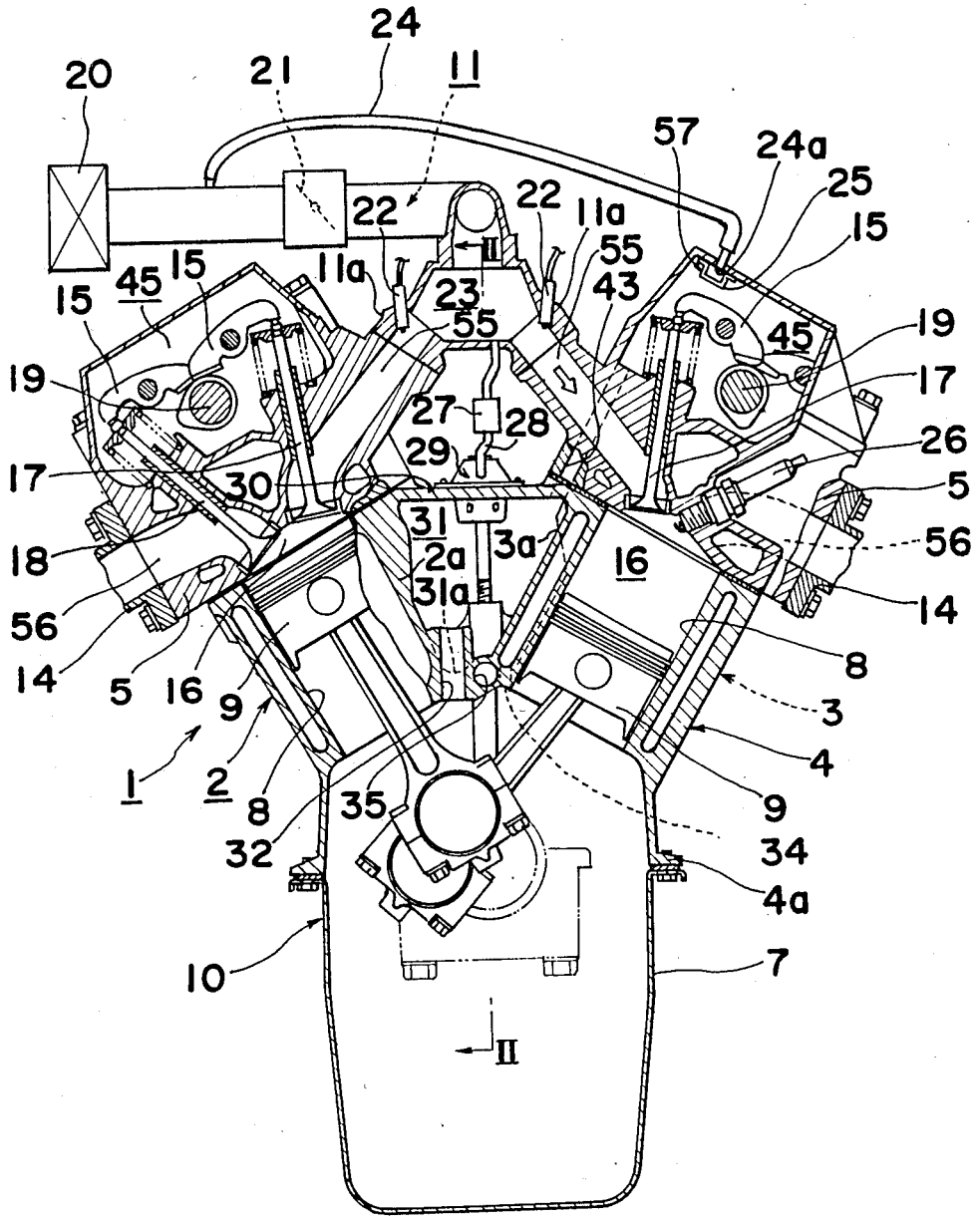
FIG. 1 is a transverse sectional view of a V-type, OHC internal combustion engine embodying the present invention.

Before the description of the present invention proceeds, it is to be noted that like parts are designated by like reference numerals throughout the accompanying drawings.

Referring to the accompanying drawings, particularly to FIG. 1 which illustrates a V-6, OHC automobile engine 1, the engine 1 includes a cylinder block structure 4 provided with first and second oppositely inclined banks 2 and 3 arranged in a generally V-shaped configuration, each bank 2 or 3 having defined therein three engine cylinders 8 in which respective pistons 9 are reciprocably mounted. The engine 1 also includes cylinder heads 5 each mounted on top of the respective bank 2 and 3 and having intake and exhaust ports 55 and 56 defined therein for each engine cylinder 8 in such respective bank, and an oil pan 7 adapted to contain lubricating oil and fluid-tightly secured to the lower marginal edge 4*a* of the cylinder block structure 4 so as to define a crankcase 10. Within the crankcase 10, a crankshaft rotatably journalled in the cylinder block structure 4 and drivingly connected with all of the pistons 9 by means of respective connecting rods is housed and extends longitudinally of the engine 1 as is well known to those skilled in the art.

Each of the cylinder heads 5, one for each bank 2 or 3, carries intake and exhaust valves 17 and 18 for each engine cylinder 8, said intake valve 17 being adapted to selectively close and open the intake port 55 while the exhaust valve 18 is adapted to selectively open and close the exhaust port 56 in timed relation to the intake valve 17 as is well known to those skilled in the art. The intake ports 55 in both of the cylinder heads 5 are communicated with respective intake conduits 11*a* which are in turn communicated together at a surge tank 23, said surge tank 23 being in turn fluid-connected with an intake piping 11. The intake piping 11 has one end remote from the surge tank 23 communicated to the atmosphere through an air cleaner 20 and also has a throttle valve 21 disposed therein between the air cleaner 20 and the surge tank 23 for regulating the flow of air therethrough. The intake conduits 11*a* have fuel injecting nozzles 22 for injecting fuel thereinto.

Figure 3:
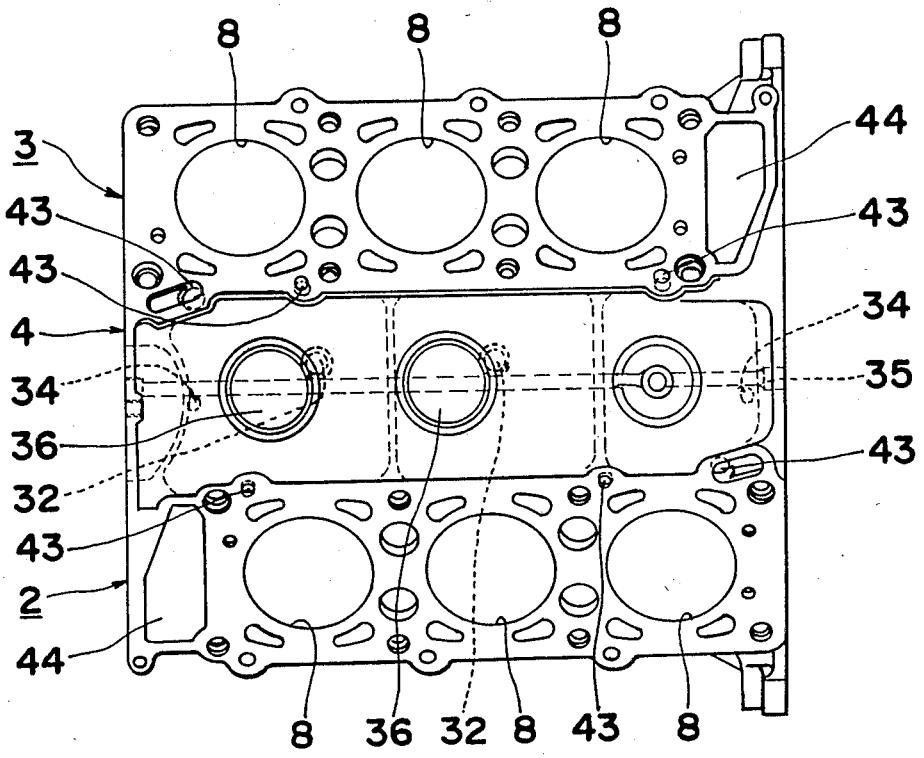
FIG. 3 is a top plan view as viewed in a direction along the line III—III in FIG. 2.

Each of the cylinder heads 5 has a respective cam chamber 45 defined therein for accommodating therein a respective cam shaft 19 and rocker arms 15. So far shown, only one of the cam chamber 45 in the cylinder head 5 for the second bank is fluid-connected through a ventilation tubing 24 with a portion of the intake piping 11 upstream of the throttle valve 21 with respect to the direction of flow of the air towards the surge tank 23, while the cam chamber 45 in the cylinder head 5 for the first bank 2 is communicated with the cam chamber 45 associated with the second bank 3 through two connecting passages 44 defined in the cylinder block structure 4 adjacent the first and second banks 2 and 3 so as to communicate between the interior of the crankcase 10 and top portions of the cylinder block structure 4 as best shown in FIG. 3. In other words, each of the connecting passages 44 defined in the cylinder block structure 4 in spaced relation to each other has its opposite ends opening into the crankcase 10 and the respective cam chamber 45 and, hence, the cam chambers 44 associated respectively with the first and second banks 2 and 3 are communicated with each other via the crankcase 10. The wall defining the cam chamber 45 associated with the second bank 3 is provided with a baffle plate 25 so positioned as to cover the opening to which one end 24*a* of the ventilation tubing 24 is connected.

The exhaust ports 56 are communicated to the atmosphere through exhaust conduits 14 by way of an exhaust gas purifying device (not shown) which may not always be essential. Also, the cylinder head 5 on each of the first and second banks 2 and 3 carries ignition plugs 26 which are employed, for example, one for each engine cylinder 8 and project into respective combustion chambers 16 defined within the engine cylinders 8 between the pistons 9 and the cylinder head 5.

Figure 2:
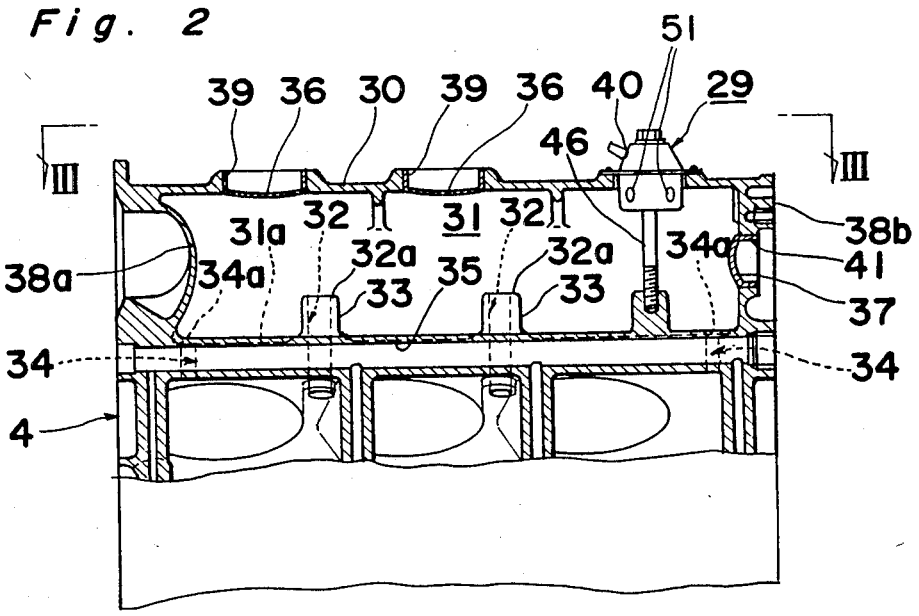
FIG. 2 is a cross-sectional view taken along the line II—II in FIG. 1.

At the top of the cylinder block structure 4, the first and second banks 2 and 3 are physically connected together by a generally rectangular top wall 30 (see FIG. 2) having its opposite side edges integral with respective inner side walls 2*a* and 3*a* of the first and second banks 2 and 3 and also having its opposite ends integral with rear and front walls 38*a* and 38*b* of the cylinder block structure 4. The cylinder block structure 4 including not only the first and second banks 2 and 3 but also the top wall 30 and the rear and front walls 38*a* and 38*b* is preferably of one-piece construction formed by the use of any known metal casting technique, and the casting of the cylinder block structure 4 is performed so as to define a pressure buffer chamber 31 within a generally triangular-sectioned space bound by the inner side walls 2*a* and 3*a* of the respective banks 2 and 3, the rear and front walls 38*a* and 38*b*, and the top wall 30 as shown in FIGS. 1 and 2. The top wall 30 has a plurality of, for example, two, first cored-out holes 39 and a second cored-out hole 40 both defined therein as best shown in FIG. 3, and the front wall 38*b* has a third cored-out hole 41 defined therein.

These cored-out holes 39, 40 and 41 are formed for the convenience of casting, that is, for the removal of a core material, originally shaped to define the shape of the pressure buffer chamber 31, subsequent to the complete casting of the cylinder block structure 4. In any event, as best shown in FIG. 2, the first and third cored-out holes 39 and 41 are completely closed by respective blind plugs 36 and 37 subsequent to the casting, whereas the second cored-out hole 40 is used to support an oil separator 29 as will be described later. Thus, it will be readily seen that the pressure buffer chamber 31 is a substantially closed, generally triangular-sectioned space.

The bottom 31*a* of the pressure buffer chamber 31 has two blow-by gas passages 32 defined therein and spaced a suitable distance from each other in a direction longitudinally of the buffer chamber 31, which passages 32 communicate between the buffer chamber 31 and the interior of the crankcase 10, as shown in FIG. 2. One of the opposite openings 2 of each of the gas passages 32, which opens towards the buffer chamber 31 as shown by 32*a* in FIG. 2, is defined by a tubular projection 33 formed integrally with the bottom 31*a* so as to project into the buffer chamber 31 through a suitable distance.

As best shown in FIGS. 2 and 3, two spaced oil return passages 34 are defined in the bottom 31*a* of the buffer chamber 31 at respective locations interiorly adjacent the rear and front walls 38*a* and 38*b* so as to communicate between the buffer chamber 31 and the interior of the crankcase 10. The cylinder block structure 4 has an oil gallery 35 defined in the wall forming the bottom 31*a* of the buffer chamber 31 so as to extend longitudinally of the engine 1 and also has a plurality of, for example, six, oil return passages 43 defined therein for permitting the return of oil within the respective cam chambers 45 to the crankcase 10.

Figure 4:
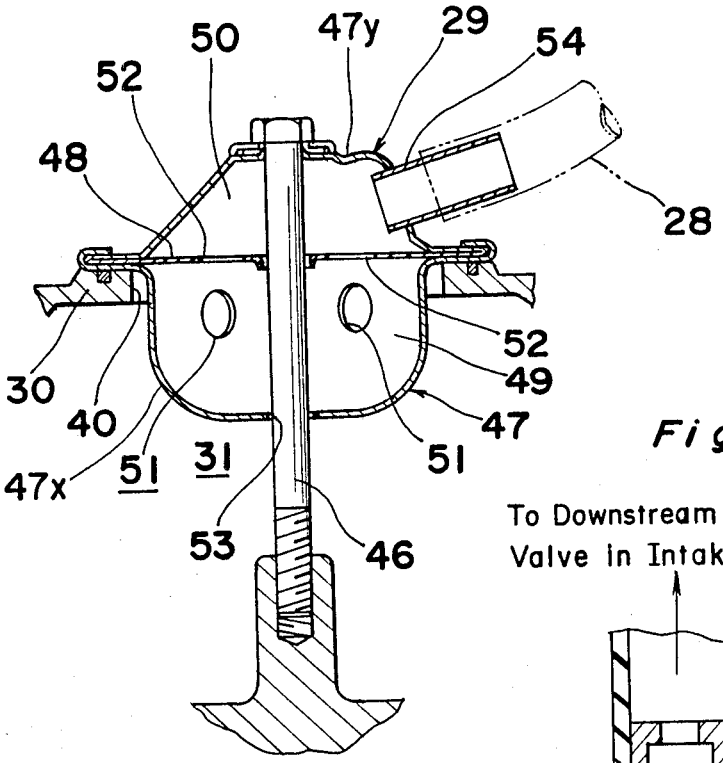
FIG. 4 is a longitudinal sectional view, on an enlarged scale, of an oil separator employed in the engine shown in FIG. 1.

The oil separator 29, the details of which are shown in FIG. 4, comprises a casing 47 comprised of a cuplike member 47*x* and a cap-like member 47*y* mounted on the cup-like member 47*x* so as to close the opening of the latter. The interior of the casing 47 is divided into first and second chambers 49 and 50 by a partition wall member 48 having its peripheral edge firmly clamped between the cuplike and cap-like members 47*x* and 47*y*, with the first chamber 49 positioned below the second chamber 50. The first and second chambers 49 and 50 are communicated with each other through a plurality of small-diameter perforations 52 defined in the partition wall member 48. The cup-like member 47*x* has its peripheral wall portion formed with a plurality of take-in openings 51 for the introduction of blow-by gases into the first chamber 49 from the buffer chamber 31 as will be described later and also has defined at the bottom thereof an oil discharge opening 53 for the discharge of oil within the first chamber 49 into the buffer chamber 31. On the other hand, the cap-like member 47*y* of the casing 47 has a connecting port 54 defined therein, which port 54 is adapted to be fluid-connected with the surge tank 23 through a connecting tube 28 having a pressure control valve 27 disposed therein as shown in FIG. 1.

As hereinbefore described, the second cored-out hole 40 defined in the top wall 30 is utilized to support the oil separator 29 of the construction shown in and described with reference to FIG. 4. More specifically, the oil separator 29 is mounted exteriorly on the top wall 30 with the cup-like member 47*x* inserted through the hole 40 into the buffer chamber 31 and with the crimped outer peripheral flange of the casing 47 fluid-tightly bolted to the top wall 30 as best shown in FIG. 4. The oil separator 29 is firmly held in position by an anchor bolt 46 passing through the casing 47 with its head positioned exteriorly of the cap-like member 47*y* and its threaded end screwed into the wall defining the bottom 31*a* of the buffer chamber 31.

Figure 5:
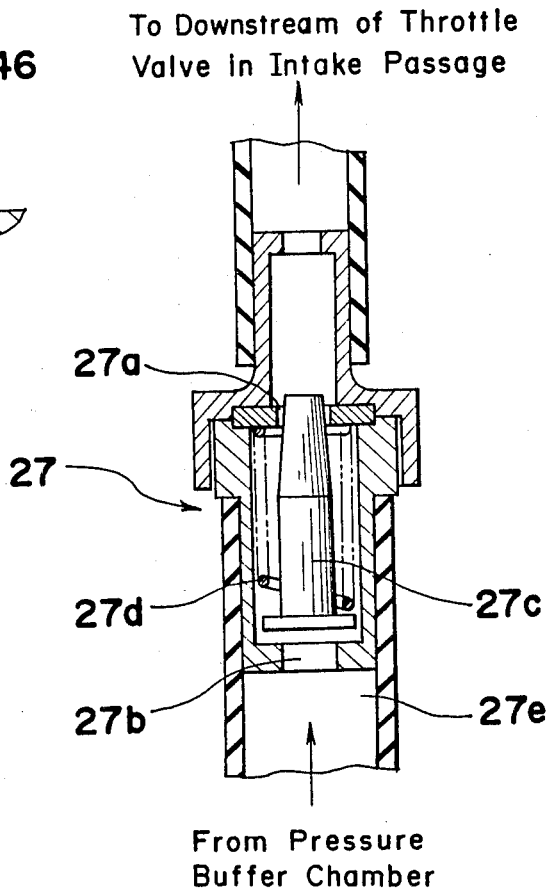
FIG. 5 is a longitudinal sectional view, on an enlarged scale, of a pressure control valve employed in the engine shown in FIG. 1.

The pressure control valve 27 disposed on the connecting tube 28 is of a design which can be opened when the negative pressure is lower than a predetermined value, to allow the flow of the blow-by gases therethrough. More specifically, referring to FIG. 5, the pressure control valve 27 comprises a generally tubular casing having its opposite ends communicated with the second chamber 50 of the oil separator 29 and the surge tank 23, a generally elongated valve member 27*c* for closing and opening valve openings 27*a* and 27*b*, and a spring 27*d* housed within the casing around the valve member 27*c*. This pressure control valve 27 is so designed that the valve member 27*c* can move upwards, as viewed in FIG. 5, to close the valve opening 27*a* when the suction negative pressure is great such as during any one of the idling, low load operating condition and deceleration of the engine 1; it can move downwards to close the valve opening 27*b* when the suction negative pressure is small such as during the high load operating condition of the engine 1; and it can open both of the valve openings 27*a* and 27*b* during a normal operating condition of the engine 1 to allow the passage of the blow-by gases therethrough towards the surge tank 23.

The crankcase ventilating system so constructed as hereinbefore described operates in the following manner.

During the operation of the engine 1, a portion of the combustion gases sequentially produced within the combustion chambers 16 escapes past the associated piston 9 and into the crankcase 10 by the reason well known to those skilled in the art. Since the blow-by gases entering the crankcase 10 may constitute an atmospheric pollutant when permitted to escape to the atmosphere, the present invention is such as to circulate the blow-by gases into the intake manifold. It is, however, pointed out that, if the blow-by gases are communicated direct to the intake manifold constituted by the intake conduits 11*a* and the surge tank 23, the flow of the blow-by gases being circulated tends to be adversely affected by changes in crankcase pressure to such an extent as to result in undesirable combustion, and/or a relatively great quantity of oil carried by the blow-by gases tends to be introduced into the intake manifold with the consequence of the increased oil consumption. For substantially eliminating these problems, and referring to the illustrated embodiment of the present invention, the blow-by gases entering the crankcase 10 are ventilated through the blow-by gas passages 32 into the buffer chamber 31 whereat the change in pressure of the blow-by gases induced by the change in crankcase pressure is lessened. Therefore, regardless of the change in pressure within the crankcase 10, the blow-by gases under a controlled pressure can be ventilated through the pressure control valve 27 into the intake piping 11 at a controlled rate. At this time, since the pressure buffer chamber 31 is formed by the utilization of the dead space between the first and second banks 2 and 3, the increased volume of the buffer chamber 31 can be relatively easily attained without the engine size increased and, therefore, the capability of the buffer chamber 31 to lessen the change in pressure of the blow-by gases can be correspondingly increased. Moreover, in such case, since the change in blow-by gas pressure is lessened within the buffer chamber 31 and since the blow-by gases are introduced from the buffer chamber 31 into the oil separator 29 while being throttled, an oil component contained in the blow-by gases can be effectively and efficiently separated from the blow-by gases within the oil separator 29 despite the fact that the oil separator 29 is of a simple structure so designed as to merely pass the blow-by gases therethrough. Thus, the effective and efficient separation of the oil component from the blow-by gases achieved by the oil separator 29 advantageously minimizes the content of the oil component in the blow-by gases being circulated into the intake piping 11.

The oil component separated from the blow-by gases within the oil separator 29 flows by gravity onto the bottom 31*a* of the buffer chamber 31 through the discharge opening 53 in the oil separator 29. The oil component separated from the blow-by gases and entering the buffer chamber 31, and oil returned from the cam chambers 45 into the buffer chamber 31 through the oil return passages 43 are in turn returned from the buffer chamber 31 to the crankcase 10 through the oil return passages 34 formed in the wall defining the bottom 31*a* of the buffer chamber 31. At this time, since the separate passages 32 and 34 are employed for the flow of the blow-by gases and the return of the oil, respectively, and since the openings 32*a* of the gas passages 32 open towards the buffer chamber 31 are located at a level above the bottom 31*a* at which respective inlets 34*a* of the oil return passages 34 open towards the buffer chamber 31, there is no possibility that the flow of the blow-by gases through the gas passages 32 may be hampered by the oil being returned to the crankcase 10 and that, conversely, the return of the oil may be hampered by the blow-by gases flowing from the crankcase 10 into the buffer chamber 31. Also, since the use of the separate passages 32 and 34 minimizes the gas-liquid contact between the blow-by gases and the oil being returned, the re-mixing of the blow-by gases and the oil can advantageously be suppressed. Accordingly, since the blow-by gases of relatively low concentration which are not re-mixed with the oil being returned can be smoothly introduced into the buffer chamber 31, that is, since the change in pressure within the buffer chamber 31 resulting from the flow resistance of the blow-by gases is small, the oil separation can be further enhanced.

Simultaneously with the circulation of the blow-by gases into the intake system of the engine 1, fresh air flowing in the intake piping 11 can be introduced from a portion of the intake piping upstream of the throttle valve 21 into the cam chambers 45 through the ventilation tubing 24 and then from the cam chambers 45 into the crankcase 10 to carry out the ventilation of the crank case 10. This crankcase ventilation is in practice performed during the low load engine operating condition wherein, because of the great suction negative pressure, a relatively large quantity of the blow-by gases is sucked into the intake piping 11 by the effect of this negative pressure. However, during the high load engine operating condition wherein, because of the small suction negative pressure the suction of the blow-by gases does not take place so much, the pressure within the crankcase 10 increases and the blow-by gases within the crankcase 10 flow into the intake piping 11 through the ventilation tubing 24. Because of this, in the illustrated embodiment, the one end 24*a* of the ventilation tubing 24 opening into the cam chamber 45 is fitted with the baffle plate 25 which, when the reverse flow of the blow-by gases from the crankcase 10 into the intake piping 11 via the cam chambers 45 takes place, acts as an oil separator 57 for separating oil from the blow-by gases then reverse-flowing.

It is to be noted that, where the top wall 30 bridging between the first and second banks 2 and 3 is formed integrally with the cylinder block structure 4 such as in the embodiment shown and described, the top wall 30 serves not only as an element for defining the buffer chamber 31, but also as a reinforcement for imparting a rigidity to both of the first and second banks 2 and 3 with the consequence that the vibration induced by the engine during the operation of the latter can be suppressed.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. In a crankcase ventilating system for a V-type, OHC internal combustion engine comprising a substantially hollow engine body structure having a pair of upwardly diverging cylinder banks and a downwardly facing opening, said engine body structure also having a pressure buffer chamber defined between opposed inner walls of the respective cylinder banks and a pair of opposite end walls with respect to the direction of an engine output shaft, said engine body structure further having a plurality of engine cylinders, defined in each of the cylinder banks, and a cam chamber defined therein at a top portion of each of the cylinder banks at a location opposite to the downwardly facing opening; an oil pan secured to the engine body structure over the downwardly facing opening to define a crankcase; and intake system for the introduction of air into the engine cylinders through an air intake passage; first oil return passages defined in the engine body structure and communicating between each of the cam chambers and the buffer chamber; and a connecting passage means communicating between the buffer chamber and the crankcase, said connecting passage means comprising a blow-dry gas passage, having one end in communication with the crankcase and the other end in communication with the buffer chamber, an end of said buffer chamber opposite the blow-by gas passage opening at a height above the bottom of said buffer chamber, and a second oil return passage having one end in communication with the crankcase and the other end opening at the bottom of and in communication with the buffer chamber, said other end ofthe blow-by gas passage being located at a level above the bottom of the buffer chamber.

2. A system as claimed in claim 1, wherein the buffer chamber is defined in a generally triangular-sectioned space delimited by the opposed inner walls of the respective cylinder banks and a top wall formed integrally with the engine body structure so as to bridge between the cylinder banks, and wherein said connecting passage means is provided at a connecting portion between the opposed inner walls of said respective cylinder banks, the other end of said blow-by gas passage projecting a distance from a wall face delimited by said connecting portion.

3. A system as claimed in claim 2, wherein the top wall has a plurality of cored-out holes defined therein for the convenience of casting of the engine body structure including the top wall.

4. A system as claimed in claim 3, wherein the engine body structure has defined therein a connecting passage means having one end in communication with a portion of the intake passage downstream of the throttle valve with respect to the direction of flow of the air towards the engine cylinders, and the other end fluid-connected with the buffer chamber through at least one of said cored-out holes, the remaining cored-out holes being completely closed by respective blind plugs.

5. A system as claimed in claim 4, further comprising a cover member provided at said at least one of the cored-out holes as a baffle plate, said baffle plate serving as an oil separator.

6. A system as claimed in claim 5, further comprising a ventilation tubing communicating between a portion of the intake passage upstream of the throttle valve and the cam chambers, and a pressure control valve disposed in the connecting passage means, said pressure control valve being operable to open said connecting passage means when a suction negative pressure is lower than a predetermined value, and wherein the engine body structure also has communicating passages defined therein, each of said communicating passages communicating between the respective cam chamber in any one of the cylinder banks and the crankcase.

7. A system as claimed in claim 1, wherein the engine body structure has defined therein a connecting passage means having one end in communication with a portion of the intake passage downstream of the throttle valve with respect to the direction of flow of the air towards the engine cylinders, and the other end fluid-connected with the buffer chamber.

8. A system as claimed in claim 7, further comprising a ventilation tubing communicating between a portion of the intake passage upstream of the throttle valve and the cam chambers, and a pressure control valve disposed in the connecting passage means, said pressure control valve being operable to open said connecting passage means when a suction negative pressure is lower than a predetermined value, and wherein the engine body structure also has communicating passages defined therein, each of said communicating passages communicating between the respective cam chamber in any one of the cylinder banks and the crankcase.

9. In a crankcase ventilating system for a V-type, OHC internal combustion engine comprising a substantially hollow engine body structure having a pair of upwardly diverging cylinder banks and a generally rectangular, downwardly facing opening, said engine body structure also having a pressure buffer chamber defined between the cylinder banks, said engine body structure further having a plurality of engine cylinders, defined in each of the cylinder banks, and a cam chamber defined therein at top of each of the cylinder banks at a location opposite to the downwardly facing opening; an oil pan secured to the engine body structure over the downwardly facing opening to define a crankcase; an intake system for the introduction of a controlled combustible air-fuel mixture into the engine cylinders, said intake system including an air intake passage having a throttle valve disposed therein for regulating the flow of the air therethrough; first oil return passages each defined in the engine body structure and communicating between each of the cam chambers and the buffer chamber; a connecting passage means communicating between the buffer chamber and the crankcase, said connecting passage means comprising a blow-by gas passage, having one end in communication with the crankcase and the other end in communication with the buffer chamber, said other end of said blow-by gas passage opening at a height above the bottom of said buffer chamber, and a second oil return passage having one end in communication with the crankcase and the other end opening at the bottom of and in communication with the buffer chamber, said other end of the gas passage being located at a level above the bottom of the buffer chamber; said buffer chamber being defined in a generally triangular-sectioned space delimited by the cylinder banks and a top wall formed integrally with the engine body structure so as to bridge between the cylinder banks above the bottom of the space of the shape of a figure "V", said top wall having a plurality of cored-out holes defined therein for the convenience of casting of the engine body structure including the top wall; said engine body structure further having defined therein a connecting passage means having one end in communication with a portion of the intake passage downstream of the throttle valve with respect to the direction of flow of the air towards the engine cylinders, and the other end fluid-connected with the buffer chamber through at least one of said cored-out holes, the remaining cored-out holes being completely closed by respective blind plugs; a cover member provided at said at least one of the cored-out holes as a baffle plate, said baffle plate serving as an oil separator; a ventilation tubing communicating between a portion of the intake passage upstream of the throttle valve and the cam chambers; a pressure control valve disposed in the connecting passage means, said pressure control valve being operable to open said connecting passage means when a suction negative pressure is lower than a predetermined value, said engine body structure also having communicating passages defined therein, each of said communicating passages communicating between the respective cam chamber in any one of the cylinder banks and the crankcase; and baffle plate positioned inside the cam chamber in at least one of the cylinder banks so as to cover the open end of the ventilation tubing which is in communication with the cam chamber.

10. In a crankcase ventilating system for a V-type, OHC internal combustion engine comprising a substantially hollow engine body structure having a pair of upwardly diverging cylinder banks and a downwardly facing opening, said engine body structure also having a pressure buffer chamber defined between opposed inner walls of the respective cylinder banks and a pair of opposite end walls with respect to the direction of an engine output shaft, said engine body structure further having a plurality of engine cylinders, defined in each of the cylinder banks, and a cam chamber defined therein at a top portion of each of the cylinder banks at a location opposite to the downwardly facing opening; an oil pan secured to the engine body structure over the downwardly facing opening to define a crankcase; an intake system for the introduction of air into the engine cylinders through an air intake passage; first oil return passages defined in the engine body structure and communicating between each of the cam chambers and the buffer chamber; and a connecting passage means communicating between the buffer chamber and the crankcase, said connecting passage means comprising a blow-by gas passage, having one end in communication with the crankcase and the other end in communication with the buffer chamber, an end of said buffer chamber opposite the blow-by gas passage opening at a height above the bottom of said buffer chamber, and a second oil return passage having one end in communication with the crankcase and the other end opening at the bottom of and in communication with the buffer chamber, said other end of the blow-by gas passage being located at a level above the bottom of the buffer chamber, an oil gallery provided adjacent the bottom of the buffer chamber and extending in a direction parallel to a crankshaft provided in the crankcase, the second oil return passage and the blow-by gas passage being adjacent the oil gallery.

11. A system as defined in claim 10, wherein the buffer chamber is covered by a top wall, the first oil return passage extending through the top wall.

12. The system as defined in claim 10, wherein the intake passage is in communication with a cam chamber.

13. A system as claimed in claim 10, wherein the top wall has a plurality of cored-out holes defined therein for the convenience of casting of the engine body structure including the top wall.

14. A system as claimed in claim 13, wherein the engine body structure has defined therein a connecting passage means having one end in communication with a portion of the intake passage downstream of the throttle valve with respect to the direction of flow of the air towards the engine cylinders, and the other end fluid-connected with the buffer chamber through at least one of said cored-out holes, the remaining cored-out holes being completely enclosed by respective blind plugs.

15. A system as claimed in claim 14, further comprising a cover member provided at said at least one of the cored-out holes as a baffle plate, said baffle plate serving as an oil separator.

16. A system as claimed in claim 10, wherein the engine body structure has defined therein a connecting passage means having one end in communication with a portion of the intake passage downstream of the throttle valve with respect to the direction of flow of the air towards the engine cylinders, and the other end fluid-connected with the buffer chamber.

* * * * *